US006108821A

United States Patent [19]

Malsoute

[11] Patent Number: 6,108,821

[45] Date of Patent: Aug. 29, 2000

[54] TROUSER BELT WITH EXTENSIBLE CLASP

[76] Inventor: Jacques Malsoute, 1, Clos de la Petite Croix 78860, Saint Nom la Breteche, France

[21] Appl. No.: 09/362,249

[22] Filed: Jul. 28, 1999

[51] Int. Cl.[7] ..... A41F 9/00

[52] U.S. Cl. ..... 2/321; 2/312; 2/338; 2/339; 24/585; 24/265 BC

[58] Field of Search ..... 2/219–221, 235–237, 2/311, 312, 319, 322, 324, 325, 338, 339, 321; 24/585, 265 BC

[56] References Cited

U.S. PATENT DOCUMENTS

| | | | |
|---|---|---|---|
| 2,147,619 | 3/1939 | Wirth . | |
| 3,466,668 | 9/1969 | Ochiai | 2/322 |
| 4,229,862 | 10/1980 | Kubeltka | 24/68 SK |
| 5,572,747 | 11/1996 | Cheng | 2/322 |
| 5,579,563 | 12/1996 | Sim | 24/585 |
| 5,588,186 | 12/1996 | Ko | 24/585 |
| 5,613,249 | 3/1997 | Ito | 2/235 |
| 5,774,952 | 7/1998 | Ito | 25/585 |

FOREIGN PATENT DOCUMENTS 0 760 218 A1 3/1997 European Pat. Off. .

WO 86/01983 4/1986 WIPO .

*Primary Examiner*—John J. Calvert
*Assistant Examiner*—Tejash Patel
*Attorney, Agent, or Firm*—Renner, Kenner, Greive, Bobak, Taylor & Weber

[57] ABSTRACT

A trouser belt, including a single-piece band with a first and second extremity, a box (1) fixed to the first extremity of the band, a plate (14) mounted so as to slide within the box (1) following the longitudinal direction and able to be linked to the second extremity by way of a buckle pin (12), at least one serration (18) longitudinally formed on the sliding plate (14), at least one tappet (25, 26) assembled in co-operation with the box in a longitudinal direction and including a protruding pin (21, 22), a helical spring (24) mounted so as to push the tappet (25, 26) in a position to lock the pin in the teeth of the serration. The mutual longitudinal movement of the box and the plate is therefore avoided, while pressure applied to the tappet against the pressure applied by the spring frees the pin from the serration to allow for the mutual longitudinal movement. A single coaxial spring (24) is implemented to at least one of said tappet (25, 26).

10 Claims, 2 Drawing Sheets

TROUSER BELT WITH EXTENSIBLE CLASP

The present invention relates to a trouser belt, which includes a single-piece band with a first and a second extremity, and a clasp consisting of a fixed box held to the first extremity of the band. The fixed box includes a plate of metal assembled so as to slide within this box following a longitudinal direction and able to be linked to the second extremity by way of a buckle pin. The clasp also includes at least one serration formed longitudinally on the sliding plate of metal, and at least one tappet assembled in co-operation with the box in a longitudinal direction, featuring a protruding pin. The clasp also includes a helical spring assembled so as to push the tappet in such a position that the pin locks in the teeth of the serration to therefore prevent the mutual longitudinal movement of the box and the plate of metal. A push on the tappet against the pressure of the spring would free the pin from the serration and therefore enable the mutual longitudinal movement.

The present invention also relates to a clasp included in a trouser belt of this type.

A belt of this type is already known by way of international patent application WO 86/01983 in the name of International Watch Co. A trouser belt of this type is also known by way of the European patent EP-0 760 218, in the name of Citizen Watch. This document mostly describes watchstraps with a view to generalize the invention, forecast the application of a clasp, previously described for a watch, to a trouser belt in FIGS. 49 and 50. Trouser belts as described in the document of the previous art featuring the following disadvantages. When clasps for extendable watches are being manufactured, the relatively small dimension of the watches makes for a relatively large tappet in the longitudinal direction, i.e. in the sense of the strap, compared to the watch itself. On the one hand, consequences of the application of this type of clasp to trouser belts are increased material cost and increased complexity. Notably, two springs are required, placed so as to act on the sides of the tappet so that it remains equilibrated whilst functioning, and therefore does not jam or twist.

In the case of the belt described in WO 86/01983, only one spring is described. However, it takes much more room within the box and the assembly is therefore complex and expensive to carry out.

The present invention relates to a trouser belt as previously described, which features a structure simpler than that of watchstraps from the previous art. On the one hand, it includes less components and, on the other hand, it requires less material for the manufacturing of the clasp. The structure however allows for a very stable operation of the clasp, without incurring imbalance or dislocation of the tappet whilst functioning.

According to the invention, only one spring is required, which is placed in a coaxial way compared to the tappet. A simpler structure is therefore obtained, which only requires a single spring.

According to an improvement of the invention, the transversal section of the spring is at least equal to half that of the tappet. A particularly stable operation of the tappet is therefore obtained without however requiring the tappet to have a large lateral dimension relative to the box. This is the case for watchstrap clasps as described in the previous art, as the dimensions of a watch are so small that a sufficiently large transversal dimension of the tappet must be implemented to enable the user to operate it.

According to an improvement of the invention, the tappet has an oblong shape, i.e. a cylindrical shape. A tappet with a particularly small transversal dimension is therefore obtained, which implies a low material cost for the manufacturing of the clasp, this dimension being however, suitable to easily operate a single or several tappets. Were the system according to the invention to be used for a watchstrap, the tappet would be too small and the operating would be difficult for the user.

An improvement of the invention calls for two parallel serrations facing each other and two coaxial tappets, the respective pins of which are associated to their corresponding serrations, and a single spring mounted in a coaxial direction between the two tappets. A particularly stable and simple operating system is therefore obtained.

The present invention also relates to a clasp for a trouser belt such as the clasp included in the trouser belt previously described.

Reference is made to the following figures, in which.

Figure 1:
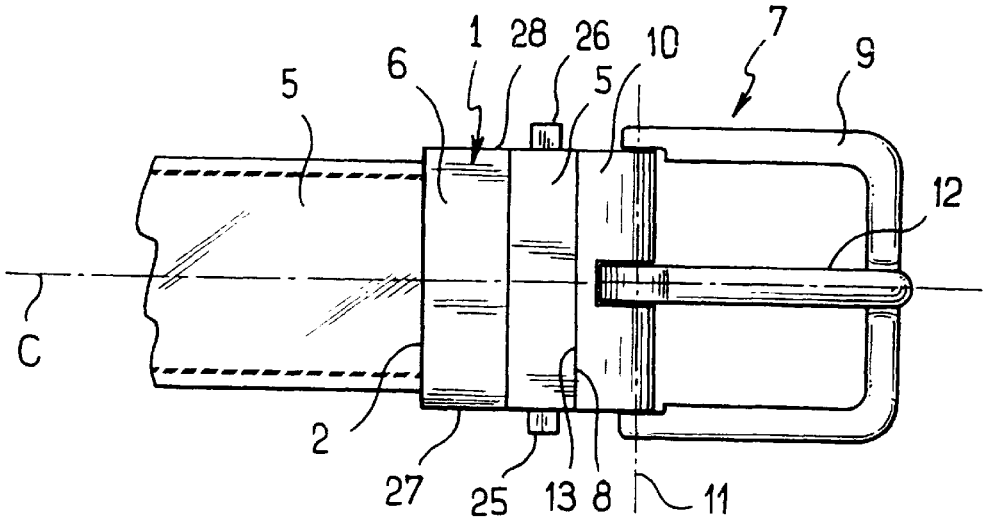
FIG. 1 is a drawing of a clasp for a trouser belt conforming to the invention, mounted on the extremity of a band or belt, the buckle being in a position of maximum proximity with the clasping part.
Figure 2:
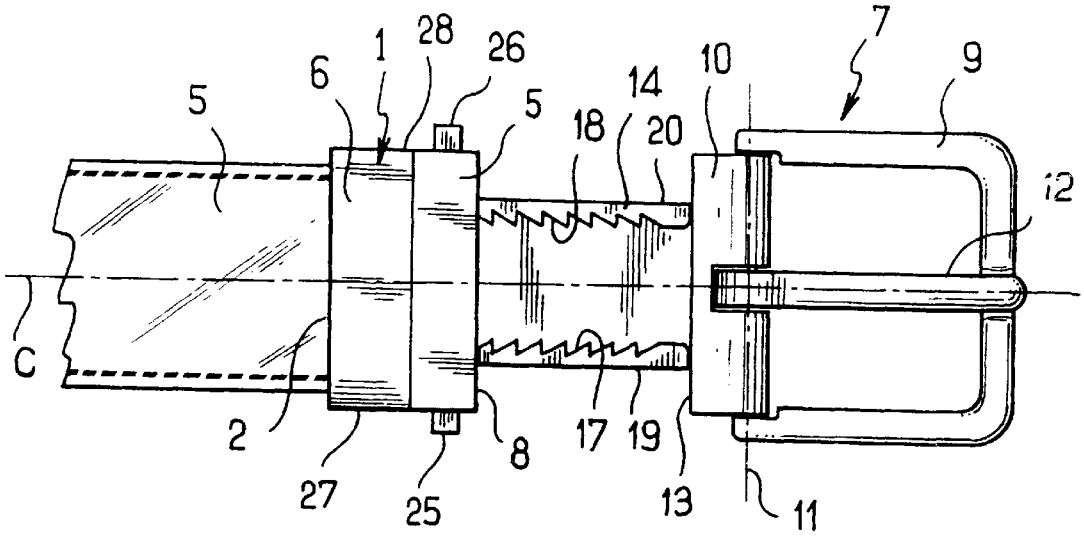
FIG. 2 is a view similar to FIG. 1, the buckle being in a position of maximum distance from the clasping part.
Figure 3:
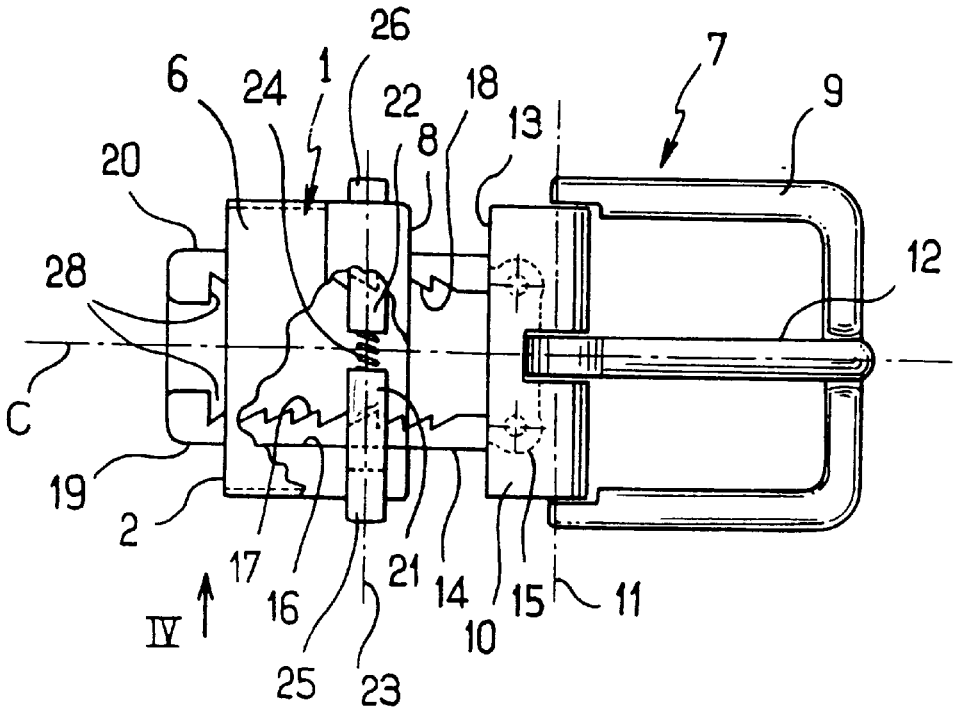
FIG. 3 is a drawing of the clasp itself with a partial internal view of the clasping part, the buckle being in a position of intermediary distance from the clasping part.
Figure 4:
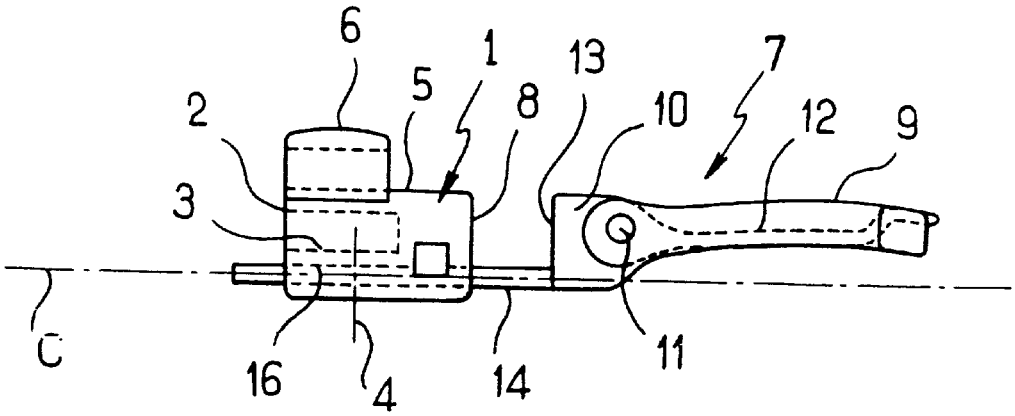
FIG. 4 is a view from aside of the clasp, following the arrow IV featured in FIG. 3.

With reference to the Figures, the extensible clasp according to the invention includes a box or clasping part 1 that can be permanently fixed at one extremity of the belt S. The clasping part 1 features a back face 2 within which is embossed a lodging 3, designed to accommodate the belt S. Screws or fixing rivets, symbolized by the dotted line 4 of FIG. 4, in lodging 3 ensures the anchoring of the belt extremity S in lodging 3.

Furthermore, the clasping part 1 is equipped with a belt loop 6, on its upper face 5, for the opposite extremity of the belt loop.

A buckle 7 with a pin 12, which is used to attach the opposite extremity (not depicted) of the belt S, is mounted on the clasping part 1, in regard of a forward face 8 opposite to the back face 2, so as to slide following the belt clasping direction C or the longitudinal direction corresponding to the longitudinal direction of the loop S. The buckle 7 includes a U-shaped ring 9, mounted on its open side on a transversal bar 10, to which it is articulated around a transversal axis 11. A buckle pin 12, perpendicular to the axis 11, is placed in the middle of the loop 9 whilst articulated to the transversal bar 10 around the axis 11 so as to penetrate one of the perforations of the corresponding extremity of belt S.

The transversal bar 10 features a back face 13 parallel and in regard of forward face 8 of the clasping part 1, opposite ring 9, and onto which is fixed a plate 14. This plate takes an oblong shape following the belting direction C or longitudinal direction, and includes a longitudinal extremity 15 which fits into a corresponding lodging of the transversal bar 13, embossed on back face 13. The plate 14 is engaged in a guiding passage 16 with a corresponding section. The guiding passage is implemented in the clasping part 1, and the plate 14 slides following the direction of fastening the belt C. The plate 14 and its guiding within the clasping part 1 therefore accomplishes the sliding fixation following the belting direction C, of the buckle 7, on the clasping part 1.

The plate 14 is equipped with two serrations 17, 18 shaped as straight teeth (zig-zag pattern), adjacent to the two lateral sides 19, 20 of plate 14 and placed so as to face each other, in order to lock in whichever position. Two tappets or ratchets 21, 22 are mounted on the clasping part 1 to slide opposite one another following a common axis 23, transversal to the direction of belting direction C and so as to co-operate with serrations 17, 18 respectively. A rappelling spring 24 is placed between ratchets 21 and 22 to push them opposite one another and therefore closer to serrations 17 and 18.

Ratchets 21 and 22 extend laterally to form tappets 25, 26 which are engaged in corresponding lateral passages of the clasping part 1, and which protrude above lateral faces 27, 28 of clasping part 1 so as to be operated.

The ratchets 21, 22 and their tappets 25, 26 are manufactured as a single piece with bevelled notches.

Use of the extensible clasp, as described, can take place in the following manner. The clasping part 1 is previously fixed permanently on the corresponding extremity of the belt loop. This extremity is received in the associated lodging 3 and anchored with screws or rivets 4. The belt S is passed through the belt loops on a pair of trousers, the free extremity of the loop S is engaged in the buckle 7 for retainment and the buckle pin 12 is engaged in the adequate perforation on the belt loop extremity. To secure the retainment and to improve the aesthetics, the remaining part of the belt loop, past buckle 7, is engaged in the belt loop 6, and if required, through another belt loop (not depicted), so as to equip the belt itself near its other extremity. The section of loop between belt loops 9 and 6 therefore, perfectly covers any in-between spacing that may exist between the back face 13 of buckle 7 and the forward face 8 of the clasping part 1.

If the user does not feel perfectly at ease and reflects that none of the existing perforations on the loop enables him to achieve a fit suited to his waistline, he may obtain a finer fit of the width by adjusting the spacing between buckle 7 and the clasping part 1. To this effect, he only needs to press both tappets 25, 26, which protrude laterally from the clasping part 1, with two fingers (for instance, with his thumb and index finger), so as to disengage ratchets 21, 22 from the serrations 17, 18 and therefore free the sliding plate 14 and the buckle 7. When buckle 7 reaches a suitably opened position, both tappets 25, 26 are simply released so that ratchets 21, 22 are brought back to bear on the serrations by the rappelling spring 24. A very fine fit of the belt width is therefore obtained with a fast, discreet and simple operation.

In particular circumstances, for instance after a meal or in a sat position, i.e. when one's waistline increases sensibly, a fast and discreet loosening of the belt can be obtained by exercising pressure with the fingers, as previously described, on tappets 25, 26 to free the plate 14 and the buckle 7. As a result of the pressure of the individual's waistline on the belt, buckle 7 then spontaneously distances itself until it reaches its position of maximum distance. In this position, a tooth 28 located at the extremity of serrations 17, 18, which is higher than the other teeth, blocks against ratchets 21, 22 even when those are in a retracted position, i.e. when tappets 25, 26 are pressed upon.

The spring 24 is a helical spring. Its tallest dimension, in the longitudinal direction, i.e. the diameter of its coils, is at least equal to half the tallest dimension of the tappet in the longitudinal direction. This last dimension is the diameter of the circular transversal section of tappets 25, 26, which have a cylindrical shape. The diameter of this circular transversal section of the tappets is 5 millimeters.

What I claim is:

1. A trouser belt, which includes:

a single-piece band with a first and second extremity;

a box fixed to the first extremity of the band;

a plate mounted so as to slide within the box following the longitudinal direction and able to be linked to the second extremity by way of a buckle pin;

at least one serration longitudinally formed on the sliding plate;

at least one tappet assembled in co-operation with the box in a longitudinal direction and including a protruding pin; and a helical spring mounted so as to push the tappet in a position in which the pin is locked in the teeth of the serration, so that mutual longitudinal movement of the box and the plate is avoided, while pressure applied to the tappet against the pressure applied by the spring frees the pin from the serration and allows for the mutual longitudinal movement; and one single spring is provided, coaxial to the said at least one tappet.

2. A belt according to claim 1, wherein the transversal section of the spring is at least equal to half the transversal section of the tappet.

3. A belt according to claims 1, wherein the tappet has an oblong shape, in particular a cylindrical shape.

4. A belt according to claim 1, wherein the spring is fixed, for instance by adhering it to the tappet.

5. A belt according to claim 1, wherein two parallel serrations are implemented face to face, two tappets, the pin each being associated to its corresponding serration, and a unique spring mounted coaxial between both tappets, are also implemented.

6. A clasp for a trouser belt including a box fixed to the first extremity of the band;

a plate mounted so as to slide within the box following the longitudinal direction and able to be linked to the second extremity by way of a buckle pin;

at least one serration longitudinally formed on the sliding plate;

at least one tappet assembled in co-operation with the box in a longitudinal direction and including a protruding pin;

a helical spring mounted so as to push the tappet in a position in which the pin is locked in the teeth of the serration, so that mutual longitudinal movement of the box and the plate is therefore avoided, while pressure applied to the tappet against the pressure applied by the spring frees the pin from the serration and allows for the mutual longitudinal movement; and one single spring is provided, coaxial to the said at least one tappet.

7. A clasp for a trouser belt according to claim 6, wherein the transversal section of the spring is at least equal to half the transversal section of the tappet.

8. A clasp for a trouser belt according to claim 6, wherein the tappet has an oblong shape, i.e. a cylindrical shape.

9. A clasp for a trouser belt according to claim 6, wherein the spring is fixed, for instance by adhering it to the tappet.

10. A clasp for a trouser belt according to claim 6, wherein two parallel serrations are implemented face to face and two tappets and pins are each associated to its corresponding serration, with a unique spring being mounted coaxially between both tappets.

* * * * *